US006795992B2

(12) United States Patent
Markelz

(10) Patent No.: US 6,795,992 B2
(45) Date of Patent: Sep. 28, 2004

(54) BRIDGE CONSTRUCTION METHOD

(76) Inventor: Paul H. Markelz, 28W 231 Oak Creek Dr., West Chicago, IL (US) 60185

( * ) Notice: Subject to any disclaimer, the term of this patent is extended or adjusted under 35 U.S.C. 154(b) by 0 days.

(21) Appl. No.: 10/264,208

(22) Filed: Oct. 3, 2002

(65) Prior Publication Data

US 2004/0064905 A1 Apr. 8, 2004

(51) Int. Cl.[7] ..... E01D 21/00
(52) U.S. Cl. ..... 14/77.1; 405/149
(58) Field of Search ..... 14/77.1; 405/149, 405/132; 52/741.1

(56) References Cited

U.S. PATENT DOCUMENTS

| | | | | | |
|---|---|---|---|---|---|
| 902,973 | A | | 11/1908 | Kundsen | |
| 3,295,276 | A | * | 1/1967 | Rene | 52/174 |
| 3,833,960 | A | | 9/1974 | Herth et al. | |
| 3,843,988 | A | | 10/1974 | Hirsch | |
| 4,009,579 | A | | 3/1977 | Patzner | |
| 4,166,509 | A | | 9/1979 | Ueno et al. | |
| 4,405,260 | A | * | 9/1983 | Tsai et al. | 405/184 |
| 4,662,019 | A | * | 5/1987 | Muller | 14/77.1 |
| 4,907,312 | A | * | 3/1990 | Yang et al. | 14/21 |
| 6,375,390 | B1 | * | 4/2002 | Lunardi | 405/146 |

* cited by examiner

*Primary Examiner*—Gary S. Hartmann
(74) *Attorney, Agent, or Firm*—Quarles & Brady LLP

(57) ABSTRACT

A method for constructing an underpass below a first section of a pre-existing first way where a first quantity of debris must be removed from an underpass space below the first section to form the underpass and enable passage of traffic along a second way. The method comprising the steps of providing foundation pairs on either side of the underpass space, each pair including first and second foundations on opposite sides of the first section, halting traffic along the first section, removing the first section, and removing at least a portion of the first quantity of debris from within the underpass space sufficient to enable installation of a superstructure substantially between the first and second foundation pairs and supported by the top ends of the first and second foundation pairs. The method further including providing a superstructure substantially between the first and second foundation pairs and supported by the top ends of the first and second foundation pairs, constructing a new first section and resuming first way traffic.

13 Claims, 4 Drawing Sheets

BRIDGE CONSTRUCTION METHOD

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to the construction of new railroad or roadway bridges and more particularly, to a method for, where two roadways or two railroad tracks or one railroad track and one roadway already exist and intersect, constructing an underpass below one of the intersecting ways to allow the second of the ways to pass there below with minimal interruption of traffic along each of the roadways. The method is also for widening an existing underpass. For the purposes of this application, the description hereinafter will focus on constructing a new railroad bridge along an active railroad track that intersects an active roadway to allow for passage of the roadway under the railroad.

One way to increase profits in the railroad industry is to increase the average rate at which trains transport product between various locations. While there are many different factors that affect average train speed, one of the more important speed determining factors includes cross traffic intersections. To this end, in order to minimize the possibility of accidents and reduce noise, many communities limit train speed through cross traffic intersections where vehicles such as cars and trucks pass across the tracks. Because train tracks have historically been laid so as to pass through small villages and towns or, in the alternative, villages and towns have sprung up along the paths defined by railroad routes, there are a large number of cross traffic intersections such that their combined affect is to appreciably reduce average train speed.

At first blush it would not appear as though slowing down a few trains at cross traffic intersections would appreciably affect average train speed. However, upon a more detailed study of train traffic patterns, it becomes apparent that an appreciable ripple effect occurs whenever even a single train is slowed. This ripple effect results from the fact that trains can only pass through a reduced speed zone such as a cross traffic intersection one at a time and often routes through reduced speed zones are the only suitable routes for trains to pass over when moving from one location to another. The result is that trains often become "stacked up" in a sort of holding pattern where trains have to, in effect, wait their turn to pass through the reduced speed zones. Thus, even trains that are traveling outside a reduced speed zone may have to slow appreciably to time their arrival at and passing through the reduced speed zones.

One way to increase average train speed has been to replace cross traffic intersections with underpasses where one of the roadway or the train track is routed underneath the other so that traffic on the track passes by traffic on the road unobstructed and vice versa. The construction industry generally has developed several different methods for constructing underpasses under existing tracks and/or roadways.

According to one method, a construction company or municipality purchases temporary rights to use land adjacent an existing trackroadway intersection and builds "run-arounds" or "shoo-flies" on the adjacent land to route both train and vehicular traffic around the intersection. Thereafter, while traffic is still traveling along the intersecting routes, the construction company lays out a temporary road and a temporary train track along the shoo-fly routes. After the track and roadway are completed, the construction company reroutes the train and vehicular traffic along the shoo-fly's thereby rendering the original intersection unused. Next the construction company excavates under the intersection, constructs foundations for a bridge on either side of the space over which the bridge is to extend, constructs abutments on top of the foundations and on either side of the space over which the bridge is to extend, installs girders that extend generally between the top ends of, and that are supported by the top ends of, the abutments, constructs one of the track or the roadway on the top of the girders and the other of the track and roadway below the girders, reroutes the train and vehicular traffic to the bridge and underpass and then must dismantle the temporary shoo-fly routes and place the land occupied thereby in its original condition.

Clearly the process of constructing shoo-flies is time consuming and very costly in the short term. In some cases underpass construction processes like the one described above take several weeks and even months to complete. Process costs are exacerbated where, as is often the case, shoo-flies have to begin and terminate several miles from an original intersection to ensure that the turns required to form the shoo-fly are not too sharp. Costs are further exacerbated when one considers the effects on railroad traffic from constructing a shoofly about an intersection. To this end, often, train speed has to be reduced along shoo-fly track segments as the turns required to accommodate the fly can cause dangerous operating conditions. Thus, during underpass construction the very problem that is to be eliminated, slowed train traffic, is exacerbated.

One way to reduce costs associated with constructing an underpass is to design the underpass/bridge construction so that the design thereof is relatively cost effective. To this end, generally, costs can be minimized by designing an underpass/bridge that minimizes the "surface height differential" between a top overpass surface of a track or roadway and the surface of an underpass below the track or roadway. This is because construction costs are at least in part related to the amount of excavating required to construct an underpass and the height of abutments required to maintain a bridge over the underpass. Thus, where the surface height differential is minimized, either required excavation can be minimized, abutment structure height can be minimized or some optimal combination of reduced excavation and minimized abutments can be chosen to reduce overall costs. Of course, in any bridge design, the lowest most portion of the bridge has to be high enough above the underpass surface to enable vehicles passing there along to clear the bridge structure.

One other consideration when designing a traffic bearing bridge is safety. To this end, in the railroad industry, wherever possible, it is desirable to have all bridge components reside outside harms way and, more specifically, below the rail road tracks supported thereby. For instance, all bridge girder components should ideally reside below track level so that any equipment attached to a train or even a derailed train will not impact the bridge components and cause or exacerbate damage.

In some cases it is impossible for a construction company or a municipality to acquire the right to temporarily use property adjacent an existing intersection for constructing shoo-flies. The industry has developed several different solutions for constructing underpasses where shoo-flies are not possible. One such solution that does not require a shoo-fly is described in U.S. Pat. No. 3,843,988 (hereinafter "the '988 patent") which issued on Oct. 29, 1974 and which is entitled "Method for Excavating an Underpass Beneath an Existing Roadway".

The '988 patent recognizes that whenever a railroad track already exists and an underpass has to be formed to either route the track or an intersecting roadway below the other of the track and roadway, because of train rerouting difficulties and stacking problems, the least expensive option is almost always to minimize train traffic disruption by constructing the underpass to pass below the track. In addition, the '988 patent recognizes that, generally, at least a portion of an underpass and associated bridge structure can be constructed prior to disrupting train traffic thereby reducing underpass construction costs overall.

To minimize track down time, the '988 patent teaches that, where an underpass is to be constructed underneath a first track section, without stopping traffic over the first track section, footings and pillars are constructed laterally of the track section and at either end of the track section including a first pair of footings and pillars including first and second pillars on a first side of the track and at opposite ends of the first section and a second pair of footings and pillars including first and second pillars on a second side of the track opposite the first side and at opposite ends of the first section.

Thereafter, first and second "springer structures" or girders (hereinafter referred to as "lateral girders") are positioned on the tops of the first and second pillar pairs, respectively, so that the girders extend along the lateral sides and the length of the first track section—hence the "lateral" girder label. Each lateral girder includes an elongated lip along its lower end that, when the girders are placed along the track section, extends toward the opposite lateral girder. After the lateral girders are in place, track traffic is halted, the first track section and sufficient debris (e.g., ballast) there under is removed from between the lateral girders and then beams or deck components are placed between the lateral girders and on top surfaces of the elongated lips to form a deck for supporting a track to be newly constructed.

The deck components are glued together via a resin of some type, ballast is placed on the supporting deck, the first track section is rebuilt, train traffic is resumed over the first track section, the remaining debris from under the springer structures and deck is removed and along approach paths and then an underpass roadway is constructed that passes under the first section.

In addition to reducing train traffic down time required to construct an underpass, the '988 patent is also advantageous as the bridge depth (i.e., the vertical dimension between the top and bottom surfaces of the bridge) of the resulting bridge is relatively minimal. This is because the combined depth of the deck components that support the track and the portions of the lateral girders below the deck (i.e., below the elongated lip extensions) is relatively minimal. This minimal depth is possible in the '988 patent solution because the deck components transfer their loads to the two lateral girders or superstructures and hence the decking components can be constructed with a minimal depth dimension.

While the '988 patent solution appears useful upon a quick perusal, the '988 patent solution has several shortcomings. First, because the '988 patent teaches that the lateral girders are installed to either lateral side of a train track, the '988 patent is limited to employing only two springer structures to support the entire downward load of the bridge thereabove. For this reason, each of the two lateral girders has to be extremely strong and hence, generally, has to have relatively large cross sectional dimensions. Because most of a bridge load is downward, the lateral girders have to have relatively large depth dimensions, where, again, the term "depth" is used to refer to the vertical dimension from the top surface to the undersurface of the lateral girder. With such a large girder depth dimension the '988 patent solution requires a tradeoff between safety and cost.

On one hand, the surface height differential may be reduced, as illustrated in the '988 patent, by configuring a bridge where the deck extends between lower ends of the lateral girders as opposed to resting on top of the girders. As discussed above, when the girders and decking materials are so arranged, both the bridge depth and the surface height differential can be minimized and hence a relatively inexpensive bridge can be designed. However, where the deck extends between the lower ends of the girders, the top ends of the lateral girders in many applications will have to extend above the track level to provide the strength required for two girders to support the entire bridge load. Thus, the girder tops will be in harm's way and will cause a hazard to trains passing over the resulting bridge.

On the other hand, a relatively safe bridge configuration may be designed using the technique described in the '988 patent where the girders are below the track level by increasing the surface height differential to accommodate the girder depth and still provide sufficient clearance for any vehicle passing through the underpass. As indicated above, unfortunately, any solution that increases the surface height differential increases costs and may not be suitable for many applications where cost is a concern.

One other underpass construction technique that does not require a shoo-fly is described in U.S. Pat. No. 3,833,960 (hereinafter "the '960 patent") which issued on Sep. 10, 1974 and which is entitled "Process for the Construction of Underpasses and an Abutment for use Therein". The '960 patent teaches that virtually all underpass construction can be completed without having to halt traffic along a pre-existing track thereabove. The '960 patent teaches that complete and massive abutment structures (i.e., the structures that actually hold up the two ends of a bridge and that typically include full wall constructs of some type) can be formed for supporting a bridge superstructure overhead. The abutment structures each includes a filler element in a superstructure support area. The '960 patent teaches that the abutments can be "sunk down" into a roadbed with their support areas facing upward and toward each other, presumably during periods when no trains are traveling over the track. Thereafter, the superstructures, presumably including girders, are forced from one side of the track into the space between the support areas and under the track section to be supported.

It is unclear whether or not the '960 patent technique could be performed. Specifically, if the '960 reference uses the term "sunk" to mean slid in laterally from the side of the track, it is unlikely that a massive abutment could possibly be slid into a position from a lateral side without causing at least some, and likely a lot of, disruption to the supporting ground structure for the track above. Moreover, how the superstructure girders could be inserted under the track thereby displacing the filler elements and debris therebetween without buckling debris under the track and thereby disrupting track traffic is unclear.

Yet one more solution for constructing an underpass without requiring shoo fly construction is referred to hereinafter as the "central support technique". According to the central support technique, during times when rail road traffic is not passing along a first track section under which an underpass is to be formed, one or several railroad tracks are removed from either side of the first track section to form openings while leaving the track intact. After the railroad ties have been removed, foundation holes are dug through the openings and concrete is poured into the openings to form footings and support pillars or the like. After the footings have been formed, train traffic is halted, the first track section is removed, excavation commences between the foundations, pier caps are mounted at the tops of the foundations, girders are mounted between the pier caps, a deck is formed on top of the girders and a new track is constructed on top of the deck.

One problem with the central support technique is that the excavating and footing forming process often requires more time than is available between passing trains. Where a train must pass during an excavating or forming process, the process has to be cut off midstream to allow a train to pass by. In some cases approaching trains have to slow down to enable removal of equipment prior to passage and may have to travel at reduced speeds while passing over a location where a bridge is being constructed. Another problem is that, after excavation between the foundations, several steps are required to construct the bridge including pier placement, girder placement, deck construction, etc. Where any one of these steps can be eliminated the track down time could be reduced which would advantageously lower costs.

BRIEF SUMMARY OF THE INVENTION

The present invention allows for construction of a new railroad track bridge without constructing a railroad by-pass while still generally allowing railroad track traffic to pass through the construction area. The invention also renders the roadway by-pass unnecessary by allowing a substantial portion of the railroad bridge underpass construction to be completed with minimal interruption to the existing roadway structure. The duration of the construction of the railroad bridge which requires the temporary closing of the roadway is very short. Thus, the invention eliminates the need for a railroad track by-pass and a roadway by-pass resulting in a substantial decrease in the required cost and time typically associated with constructing a the new railroad bridge underpass. The invention is equally applicable as a method and system for extending an already existing bridge.

In one embodiment, the invention includes a method for constructing an underpass below a first section of a pre-existing first way where a first quantity of debris must be removed from an underpass space below the first section to form the underpass and enable passage of traffic along a second way, the method comprising the steps of providing foundation pairs on either side of the underpass space, each pair including first and second foundations on opposite sides of the first section, halting traffic along the first section, removing the first section, removing at least a portion of the first quantity of debris from within the underpass space sufficient to enable installation of a superstructure substantially between the first and second foundation pairs and supported by the top ends of the first and second foundation pairs, providing a superstructure substantially between the first and second foundation pairs and supported by the top ends of the first and second foundation pairs, constructing a new first section and resuming first way traffic.

In at least some embodiments the method further includes the steps of, prior to halting traffic along the first section, providing a rigid first pier cap between the first and second foundations of the first foundation pair below the first way and providing a second rigid pier cap between the first and second foundations of the second foundation pair below the first way and, wherein, the step of providing a superstructure includes providing a superstructure substantially between the first and second pier caps and supported by the top ends of the first and second pier caps. Here, the step of providing a superstructure may include providing at least one girder substantially between the first and second pier caps and within the underpass space.

Each step of providing a pier cap may include positioning a prefabricated pier cap on top of each of a corresponding foundation pair. In addition, the step of providing a superstructure may include providing at least one prefabricated girder that traverses the distance between and is supported by the first and second pier caps.

In some cases the second way is also pre-existing, the step of providing foundation pairs includes providing the first and second pairs on opposite sides of the second way and the step of halting traffic includes halting traffic along each of the first and second ways.

In some embodiments the method further includes the step of, after resuming first way traffic, further excavating the remainder of the first quantity of debris to provide the underpass space and constructing the second way within the underpass space.

Each step of providing a pier cap may include tunneling below the first way and providing the pier cap within the tunnel.

In at least one embodiment a second section is adjacent the first section and the method further includes the steps of, providing a third foundation pair on a side of the second section opposite the first section and separated from the first foundation pair by a first approach space below the second section, the third foundation pair including first and second foundations on opposite sides of the second section, halting traffic along the second section, removing the second section, removing at least a portion of the debris from within the first approach space sufficient to enable installation of a superstructure substantially between the third and first foundation pairs and supported by the top ends of the third and first foundation pairs, providing a superstructure substantially between the third and first foundation pairs and supported by the top ends of the third and first foundation pairs and within the excavated space, constructing a new second section and resuming first way traffic.

Here a third section may be adjacent the first section on a side of the first section opposite the second section and the method may further include the steps of, providing a fourth foundation pair on a side of the third section opposite the first section and separated from the second foundation pair by a second approach space below the third section, the fourth foundation pair including first and second foundations on opposite sides of the third section, halting traffic along the third section, removing the second section, removing at least a portion of the debris from within the second approach space sufficient to enable installation of a superstructure substantially between the fourth and second foundation pairs and supported by the top ends of the fourth and second foundation pairs, providing a superstructure substantially between the fourth and second foundation pairs and supported by the top ends of the fourth and second foundation pairs and within the excavated space, constructing a new third section and resuming first way traffic.

The halting, removing, providing and constructing steps may be performed for each of the first, second and third sections during first, second and third separate and consecutive underpass construction periods. More specifically, the halting, removing, providing and constructing steps may be performed for the second and third sections prior to performing the halting, removing, providing and constructing steps for the first section.

In the alternative, traffic may be halted along all of the first, second and third sections at the same time, the removing steps may be performed for each of the first, second and third sections and the debris there under during a single removal period, the providing steps may be performed during a single providing period and the constructing steps may be performed during a single construction period.

The invention also includes a method for constructing an underpass below a first section of a pre-existing first way where a first quantity of debris must be removed from an underpass space below the first section to form the underpass and enable passage of traffic along a second way, the method comprising the steps of providing foundation pairs on either side of the underpass space, each pair including first and second foundations on opposite sides of the first section, providing a rigid first pier cap between the first and second foundations of the first foundation pair below the first way, providing a second rigid pier cap between the first and second foundations of the second foundation pair below the first way, halting traffic along the first section, removing the first section, removing at least a portion of the first quantity of debris from within the underpass space sufficient to enable installation of a superstructure substantially between the first and second foundation pairs and supported by the top ends of the first and second foundation pairs, providing a superstructure substantially between the first and second pier caps and supported by the top ends of the first and second pier caps, constructing a new first section, resuming first way traffic and clearing the remainder of the first quantity from below the superstructure to form the underpass.

The invention further includes a bridge constructed to support a pre-existing first way over an underpass below a first section of the first way where a first quantity of debris must be removed from an underpass space below the first section to form the underpass and enable passage of traffic along a second way, the bridge constructed by performing the following process: providing foundation pairs on either side of the underpass space, each pair including first and second foundations on opposite sides of the first section, halting traffic along the first section, removing the first section, removing at least a portion of the first quantity of debris from within the underpass space sufficient to enable installation of a superstructure substantially between the first and second foundation pairs and supported by the top ends of the first and second foundation pairs, providing a superstructure substantially between the first and second foundation pairs and supported by the top ends of the first and second foundation pairs, constructing a new first section and resuming first way traffic.

Here, prior to halting traffic along the first section the process to construct the bridge may include providing a rigid first pier cap between the first and second foundations of the first foundation pair below the first way and providing a second rigid pier cap between the first and second foundations of the second foundation pair below the first way and, wherein, the step of providing a superstructure includes providing a superstructure substantially between the first and second pier caps and supported by the top ends of the first and second pier caps.

Thus, one object of the invention is to provide a bridge construction method that requires only minimal stoppage of traffic passing over a railroad or the like. To this end, the present invention facilitates construction of several of the components required to construct an underpass under an existing railroad track prior to disrupting track traffic. Importantly, in at least some embodiments, the bridge components that are either labor intensive or require a relatively large amount of time to install and/or form are installed and/or formed during the pre-stoppage period. For instance, the foundations that often have to be pile driven into the ground or that are constructed out of concrete that typically has to cure for several days prior to bearing a load can be completely formed and constructed prior to stoppage.

Consistent with the object of constructing as much of a bridge as possible prior to halting track traffic, at least some embodiments of the method require pier caps to be formed prior to halting traffic.

Another object is to construct an underpass where all bridge components are out of harms way and generally reside below the track level. To this end the inventive method results in a bridge where the superstructure is below track level and resides below the track as opposed to laterally of the track.

These and other objects, advantages and aspects of the invention will become apparent from the following description. In the description, reference is made to the accompanying drawings which form a part hereof, and in which there is shown one embodiment of the invention. Such embodiment does not necessarily represent the full scope of the invention and reference is made therefore, to the claims herein for interpreting the scope of the invention.

DETAILED DESCRIPTION OF THE INVENTION

Figure 1:
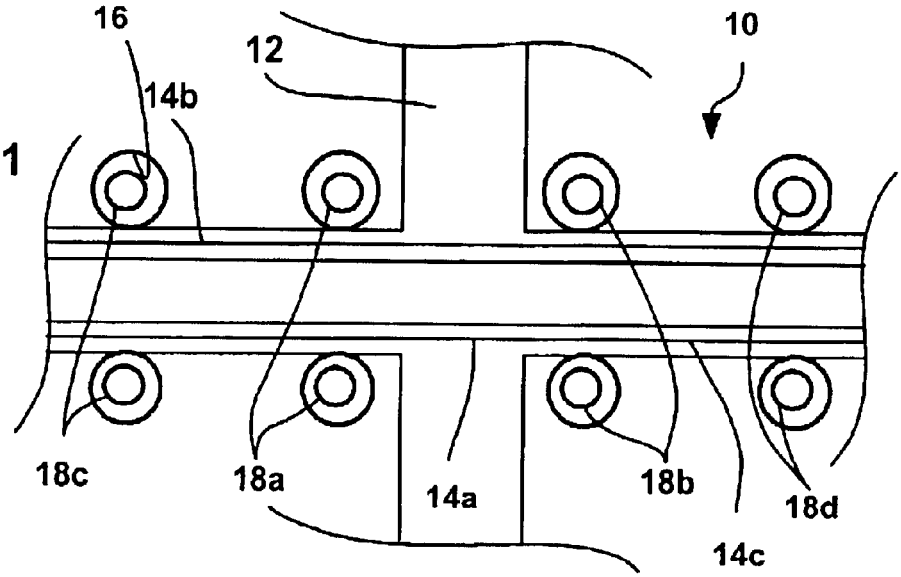
FIG. 1 is a top plan view of an exemplary railroad—roadway intersection with soil below each of the railroad and roadway.
Figure 2:
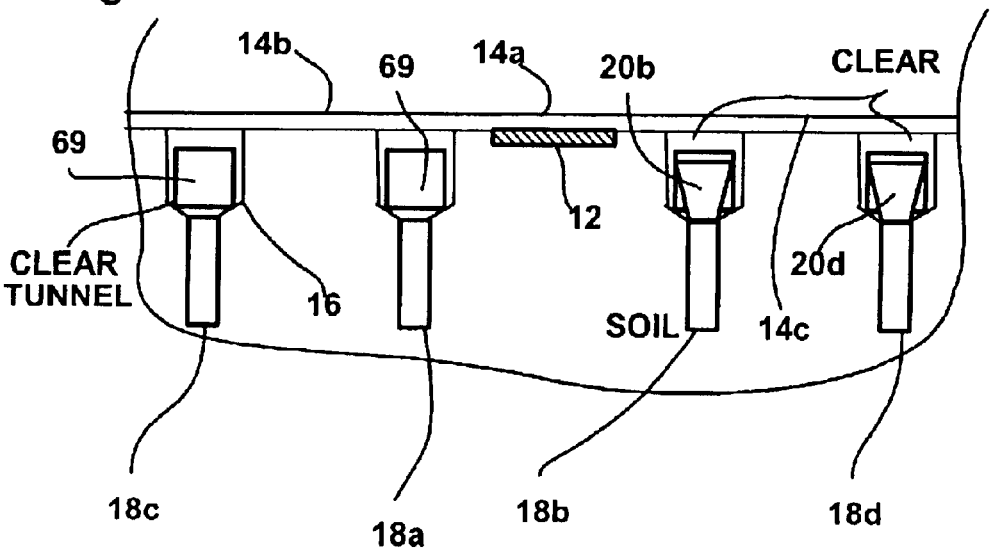
FIG. 2 is a partial cross-sectional view taken along a trajectory parallel to the roadway illustrating the intersection of FIG. 1.

Referring now to the drawings wherein like reference numerals represent similar elements throughout the several views and, more specifically, referring to FIGS. 1 and 2, there is shown in FIGS. 1 and 2 an intersection 10 including a roadway 12 which crosses at a right angle with a railroad track including first, second and third track sections 14*a,* 14*b* and 14*c,* respectively. Hereinafter the track is generally referred to by reference numeral 14. As illustrated, both roadway 12 and track 14 are initially on the same level (i.e., neither of the roadway 12 nor track 14 passes above or under the other). According to the present invention, instead of building one or more shoo-flies around the intersection 10 to build a bridge over roadway 12, supporting structures including foundations are built adjacent the roadway 12 and the track 14 such that the foundations do not structurally interfere with the track or the roadway.

These foundations may take any form known in the construction industry such as driven steel piles that are proof loaded, drilled shafts where a steel tube or the like is fed into a deep shaft via a drill head and thereafter, as concrete is pumped into the shaft, the steel tube is removed thereby forming a pylon of sorts. In the illustrated example concrete pylons 18*a*–18*d* formed inside deep shafts 16 are illustrated. The entire pylon or foundation construction building process can be performed without stopping traffic along either of roadway 12 or track 14. Hereinafter, to stress that any type of suitable foundation may be used with the present invention pylons 18*a*–18*d* will be referred to generically as foundations 18*a*–18*d*. In at least one example of the inventive method the top ends of the foundations may be approximately 10 feet below the railroad track thereabove (the illustrations are not to scale).

The foundations include foundation pairs 18*a*–18*d* where each pair includes two separate foundations 18 on opposite sides of the first way (i.e., track 14). In FIG. 2, the foundation pairs will be referred to generally as, from left to right as illustrated, third, first, second and fourth foundation pairs 18*c,* 18*a,* 18*b* and 18*d,* respectively. The spaces between the third and first pairs 18*c* and 18*a,* the first and second pairs 18*a* and 18*b* and the second and fourth pairs 18*b* and 18*d* that have to be cleared to form the underpass will be referred to generally as a first approach space, an underpass space and a second approach space, respectively. The debris to be removed from between the third and first pairs 18*c* and 18*a,* the first and second pairs 18*a* and 18*b* and the second and fourth pairs 18*b* and 18*d* during the construction process will be referred to generally as second, first and third quantities, respectively.

Figure 3:
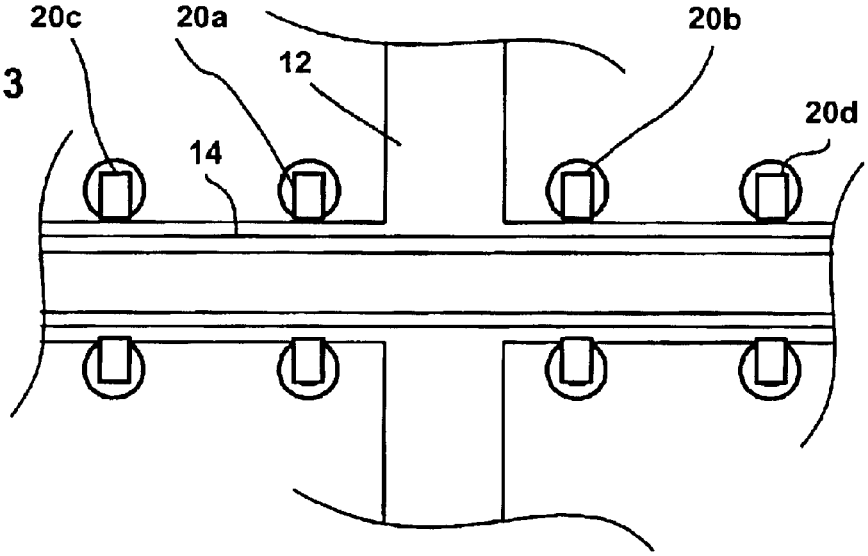
FIG. 3 is similar to FIG. 1, albeit illustrating the inventive method at a further stage of completion.
Figure 4:
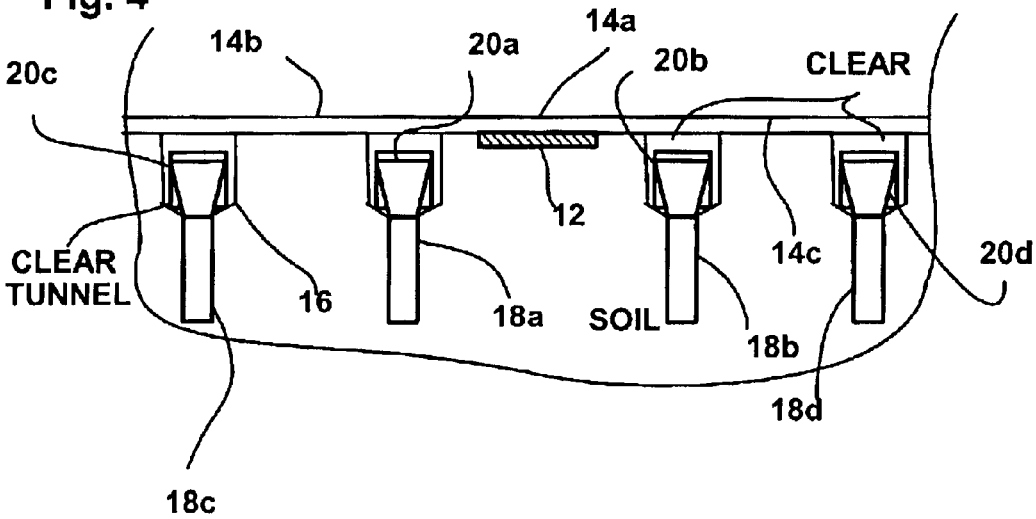
FIG. 4 is similar to FIG. 2, albeit corresponding to FIG. 3.

Referring now to FIGS. 3 and 4, after foundation pairs 18*a*–18*d* have been completely constructed, while railroad track traffic along railroad track 14 continues, pier caps 20*a*–20*d* (i.e., the second main component of the supporting structure) are constructed that pass under railroad track 14 and, as their label implies, cap corresponding foundation pairs to provide structure below railroad track 14.

To construct the caps 20*a*–20*d* some type of supported tunneling process is performed. For instance, tunnels 69 for the caps may be manually dug at the tops of the foundation pairs 18*a*–18*d* and several feet (e.g., 5) below the track 14. As tunnels 69 are dug, side and ceiling support structure may be built to provide support for soil and ballast thereabove. In the alternative a large drill assembly may be employed for horizontally forming the pier cap tunnels. In at least one embodiments the drill head may pull a large steel tube there behind through the tunnel to provide support and also to provide a passageway for removal of soil and other debris to be removed from the tunnel.

After tunnels 69 have been formed any type of suitable cap structure may be employed. For instance, pre-caste concrete pier caps may be employed. In the alternative, forms may be set within the tunnels and concrete piers may be poured within the forms. One other alternative is to use steel girders to form the pier caps. Other suitable cap forming methods and assemblies are contemplated. In FIG. 2 the two left most pier caps 20*b* and 20*d* are illustrated while only tunnels 69 are illustrated on the left side of roadway 12. Again, up to this point neither railroad nor roadway traffic needs to be halted or slowed. Consistent with the nomenclature adopted above to refer to foundation pairs 18*a*–18*d*, pier caps 20*a*–20*d* in FIG. 4 will be referred to, from left to right as illustrated, third, first, second and fourth pier caps 20*c,* 20*a,* 20*b* and 20*d,* respectively.

Figure 5:
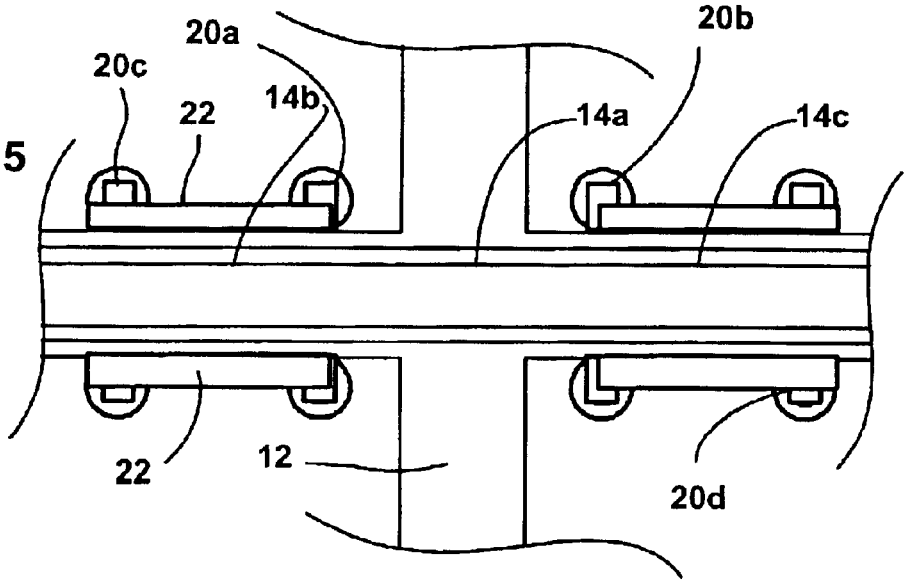
FIG. 5 is similar to FIG. 1, albeit at a different stage of completion.
Figure 6:
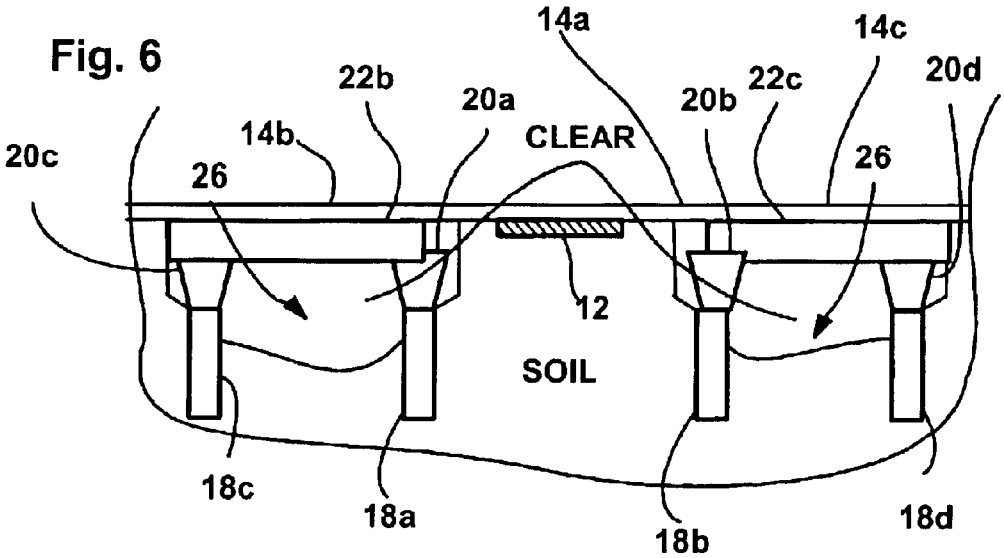
FIG. 6 is similar to FIG. 2, albeit corresponding to FIG. 5.

Next, referring to FIGS. 5 and 6, after pier caps 20*a*–20*d* have been installed railroad track traffic may be halted for a short time while the second and third track sections 14*b* and 14*c* and quantums of debris 26 thereunder are removed where the quantums of debris are sufficient to allow second and third approach girders 22*b* and 22*c,* respectively, to be installed between the pier caps (see FIGS. 5 and 6) on each side of roadway 12. Next, a deck is constructed on top of the approach girders and new track sections 14*b* and 14*c* are constructed.

Figure 7:
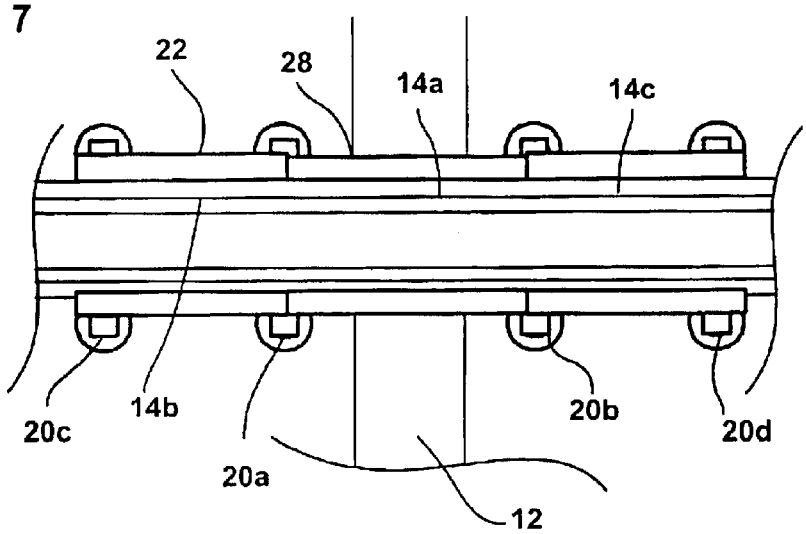
FIG. 7 is similar to FIG. 1, albeit illustrating a final stage of completion.

Importantly, where the amount of soil and debris that must be removed to form the underpass between the third and first foundation pairs 18*c* and 18*a* and between the second and fourth foundation pairs 18*b* and 18*d* are second and third quantities, only a portion of each of the second and third quantities must be removed to enable placement of the girder superstructures between caps 20*c* and 20*a* and between caps 20*b* and 20*d.* This is important as soil removal is a time consuming process and, during removal, track traffic is generally halted. Thus, by limiting the soil removed during this step to the amount of soil required to install the approach girders 22*b* and 22*c,* traffic delays are minimized. This is also true of the next excavation step corresponding to central girder 22*a* (see FIGS. 7 and 8) where the amount of soil removed should be limited generally to the amount of soil required to be removed to facilitate easy installation of girder 28.

Continuing, to install a central girder 22*a* between pier caps 20*a* and 20*b,* traffic along roadway 12 must be halted and traffic along railroad 14 must be halted for a short period. During this time, central track segment 14*a* and sufficient soil (e.g., less than the first quantity) and other debris from within the underpass space 32 between foundations 18*a* and 18*b* is removed to allow central girder 22*a* to be installed within the intersecting space, a deck is built thereabove to support a new central track segment 14*a,* the new central segment 14*a* is constructed and railroad traffic can be resumed. At this point roadway traffic should not have to be halted again during continued construction of roadway 30 thereunder. Underpass space 32 is then completely excavated and roadway 30 construction is completed below central girder 22*a.*

If desired, the steps illustrated in FIGS. 5 through 8 may be performed at the same time so that railroad traffic does not have to be halted twice. Thus, after the pier caps 20*a*–20*d* have been installed, track 14 traffic can be halted, all three track segments 14*a*–14*c* can be removed and debris thereunder can be removed in a quantity that facilitates installation of the approach and central spans. This process does not require removal of all of the soil that will eventually be removed to facilitate vehicular passage therebelow but rather just enough (e.g., 5 feet of soil) so that the spans can be installed. Thereafter, after the spans 22*a*–22*d* are installed, a deck and track segments 14*a*–14*c* are installed and traffic can resume. The remainder of the soil from below the spans is then removed and roadway 12 can be constructed below the bridge.

Figure 8:
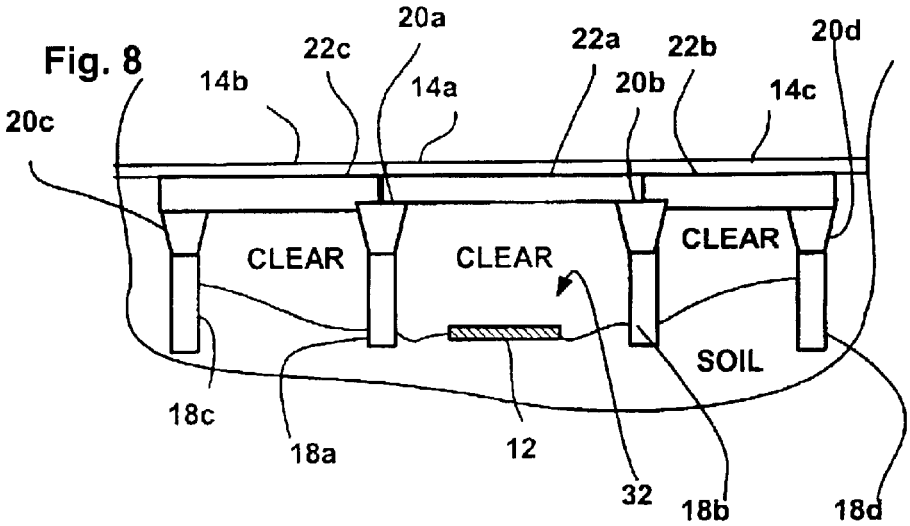
FIG. 8 is similar to FIG. 2, albeit corresponding to FIG. 7.
Figure 9:
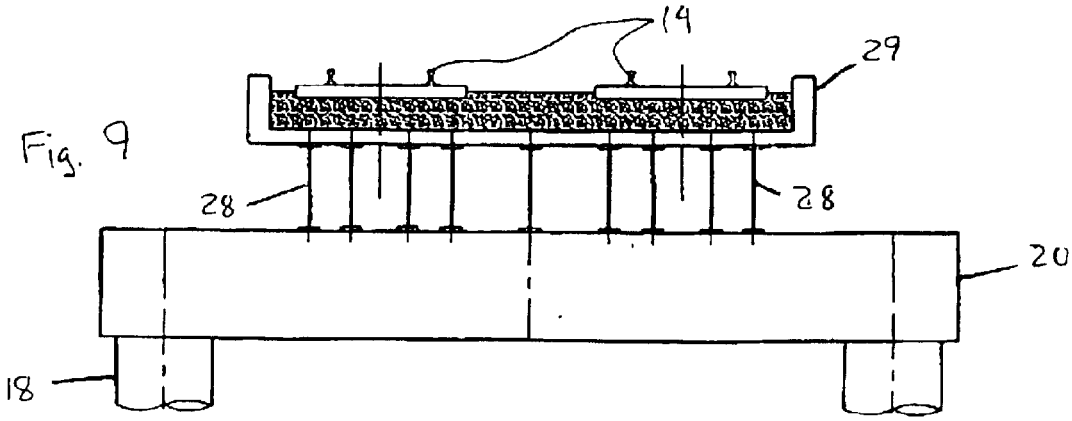
FIG. 9 is a typical cross-sectional view of a completed bridge taken along the line 9—9 of FIG. 8.

Referring now to FIG. 9, a partial cross-sectional view taken along the line 9—9 of FIG. 8 is illustrated to show, generally, a completed bridge according to at least one embodiment of the present invention. To this end, an exemplary pier cap 20 is shown as straddling the tops of a pair of pylons 18. Exemplary girders 28 are provided on the top surface of pier cap 20 and a deck 29 is built and supported on the tops of girders 28. A two lane railroad 14 is shown built and constructed on top of deck 29.

In another embodiment of the present invention, instead of providing four separate pier caps 20*a*–20*d* and corresponding foundation pairs or the like 18*a*–18*d,* two separate pier caps 20*a* and 20*b* and corresponding foundation pairs 18*a* and 18*b* may be provided on opposite sides of the roadway 12 without stopping either roadway 12 or railroad 14 traffic. Thereafter, both roadway and railroad traffic may be halted for a short time while the space for a new roadway or at least enough space to install a girder 22*a* (i.e., space 32 in FIG. 8) is cleared of soil and other debris. Next, girder 22*a* is provided between the first and second foundation pairs 18*a* and 18*b* and the deck and a new track section 14*a* are constructed. Thereafter the remainder of debris in the underpass space 32 is removed and the new roadway 30 is provided below span 28. If necessary, complete abutments may be added between the foundation in each pair to hold back the soil on either side of the underpass. In this case, fewer pylons and spans have to be constructed.

In yet one other embodiment, where, as in the case of FIG. 9, a railroad includes two lanes that pass through an intersection, it is contemplated that the downtime during which both of the lanes of a railroad are closed could be even further minimized or essentially eliminated. To this end, according to another embodiment of the invention, the steps described above where the railroad traffic has to be halted for short durations may include halting the traffic along one of the two railroad lanes while allowing traffic to pass along the other of the two railroad lanes while the steps described above are performed for the closed lane. Thereafter, traffic along the second of the railroad lanes would be halted while traffic along the first of the lanes would continue as the steps above are performed for the second of the railroad lanes. To this end, it is contemplated that, in at least some embodiments, a third pier may have to be provided between railroad lanes and thus the third pier along with one of the other two piers outside the lanes could be employed to support a pier cap and girder thereabove.

It should be understood that the methods and apparatuses described above are only exemplary and do not limit the scope of the invention, and that various modifications could be made by those skilled in the art that would fall under the scope of the invention.

To apprise the public of the scope of this invention, the following claims are made.

What is claimed is:

1. A method for constructing an underpass below a first section of a pre-existing first way where a first quantity of debris must be removed from an underpass space below the first section to form the underpass and enable passage of traffic along a second way, the method comprising the steps of:

providing foundation pairs on either side of the underpass space, each pair including first and second foundations on opposite sides of the first section;

providing a rigid first pier cap between the first and second foundations of the first foundation pair below the first way;

providing a second rigid pier cap between the first and second foundations of the second foundation pair below the first way halting traffic along the first section;

removing the first section;

removing at least a portion of the first quantity of debris from within the underpass space sufficient to enable installation of a superstructure substantially between the first and second foundation pairs and supported by the top ends of the first and second foundation pairs;

providing a superstructure substantially between the first and second pier caps and supported by the top ends of the first and second pier caps;

constructing a new first section; and resuming first way traffic.

2. The method of claim 1 wherein the step of providing a superstructure includes providing at least one girder substantially between the first and second pier caps and within the underpass space.

3. The method of claim 1 wherein each step of providing a pier cap includes positioning a prefabricated pier cap on top of each of a corresponding foundation pair.

4. The apparatus of claim 3 wherein the step of providing a superstructure includes providing at least one prefabricated girder that traverses the distance between and is supported by the first and second pier caps.

5. The method of claim 1 wherein the second way is also pre-existing, the step of providing foundation pairs includes providing the first and second pairs on opposite sides of the second way and, wherein, the step of halting traffic including halting traffic along each of the first and second ways.

6. The method of claim 1 further including the step of, after resuming first way traffic, further excavating the remainder of the first quantity of debris to provide the underpass space and constructing the second way within the underpass space.

7. The method of claim 1 wherein each step of providing a pier cap includes tunneling below the first way and providing the pier cap within the tunnel.

8. The method of claim 1 wherein a second section is adjacent the first section and the method further includes the step of, providing a third foundation pair on a side of the second section opposite the first section and separated from the first foundation pair by a first approach space below the second section, the third foundation pair including first and second foundations on opposite sides of the second section, halting traffic along the second section, removing the second section, removing at least a portion of the debris from within the first approach space sufficient to enable installation of a superstructure substantially between the third and first foundation pairs and supported by the top ends of the third and first foundation pairs, providing a superstructure substantially between the third and first foundation pairs and supported by the top ends of the third and first foundation pairs and within the excavated space, constructing a new second section and resuming first way traffic.

9. The method of claim 8 wherein a third section is adjacent the first section on a side of the first section opposite the second section and the method further includes the step of, providing a fourth foundation pair on a side of the third section opposite the first section and separated from the second foundation pair by a second approach space below the third section, the fourth foundation pair including first and second foundations on opposite sides of the third section, halting traffic along the third section, removing the second section, removing at least a portion of the debris from within the second approach space sufficient to enable installation of a superstructure substantially between the fourth and second foundation pairs and supported by the top ends of the fourth and second foundation pairs, providing a superstructure substantially between the fourth and second foundation pairs and supported by the top ends of the fourth and second foundation pairs and within the excavated space, constructing a new third section and resuming first way traffic.

10. The method of claim 9 wherein the halting, removing, providing and constructing steps are performed for each of the first, second and third sections during first, second and third separate and consecutive underpass construction periods.

11. The method of claim 10 wherein the halting, removing, providing and constructing steps are performed for the second and third sections prior to performing the halting, removing, providing and constructing steps for the first section.

12. The method of claim 9 wherein traffic is halted along all of the first, second and third sections at the same time, the removing steps are performed for each of the first, second and third sections and the debris there under during a single removal period, the providing steps are performed during a single providing period and the constructing steps are performed during a single construction period.

13. The method of claim 1 wherein the first way is a railroad track.

* * * * *